US009574364B2

(12) United States Patent
Katayama et al.

(10) Patent No.: US 9,574,364 B2
(45) Date of Patent: Feb. 21, 2017

(54) SEISMIC ISOLATION DEVICE AND SEISMIC ISOLATION METHOD

(71) Applicant: KABUSHIKI KAISHA TOSHIBA, Minato-Ku (JP)

(72) Inventors: Hiroshi Katayama, Yokohama (JP); Urara Watanabe, Yokohama (JP); Gaku Nakamura, Yokohama (JP); Yoshitaka Nihira, Yokohama (JP); Tetsuharu Tanoue, Meguro (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 0 days.

(21) Appl. No.: 14/919,885

(22) Filed: Oct. 22, 2015

(65) Prior Publication Data

US 2016/0115703 A1 Apr. 28, 2016

(30) Foreign Application Priority Data

Oct. 24, 2014 (JP) ..... 2014-217146

(51) Int. Cl.
*E04B 1/98* (2006.01)
*E04H 9/02* (2006.01)

(52) U.S. Cl.
CPC ..... *E04H 9/022* (2013.01); *E04H 9/02* (2013.01); *E04H 9/021* (2013.01); *E04H 9/027* (2013.01); *E04H 2009/026* (2013.01)

(58) Field of Classification Search
CPC ..... E04H 9/022; E04H 9/021; E04H 9/02; E04H 2009/026; E04H 2009/027; E04H 9/027
USPC ..... 52/167.8, 167.7, 167.4, 167.1, 741.3, 52/167.6
See application file for complete search history.

(56) References Cited

U.S. PATENT DOCUMENTS 2,359,915 A * 10/1944 Hussman ..... B63B 3/13 100/295
4,565,039 A * 1/1986 Oguro ..... E02D 27/34 248/567
4,587,773 A * 5/1986 Valencia ..... E04H 9/021 52/1
4,991,366 A * 2/1991 Teramura ..... E04H 9/021 188/136
5,462,141 A * 10/1995 Taylor ..... E04H 9/02 188/280

(Continued)

FOREIGN PATENT DOCUMENTS

JP 03-275873 12/1991
JP 2009-264027 11/2009
JP 2011-099462 5/2011

*Primary Examiner* — Chi Q Nguyen
(74) *Attorney, Agent, or Firm* — Oblon, McClelland, Maier & Neustadt, L.L.P.

(57) ABSTRACT

A seismic isolation apparatus is provided between a structure and a foundation floor, and the seismic isolation apparatus includes: a support plate that is provided so as to face the structure at a predetermined interval; a base plate that is fixed to the foundation floor; and an elasto-plastic damper that is provided between the support plate and the base plate to be fixed to the support plate and the base plate. The elasto-plastic damper includes an inner cylinder inside which an elasto-plastic member is provided and an outer cylinder, and the inner cylinder and the outer cylinder are configured to mutually slide in an axis direction thereof.

12 Claims, 8 Drawing Sheets

(56) References Cited

U.S. PATENT DOCUMENTS

| | | | | |
|---|---|---|---|---|
| 5,816,559 | A * | 10/1998 | Fujimoto | E04H 9/021 248/562 |
| 6,648,295 | B2 * | 11/2003 | Herren | F16F 15/0275 248/562 |
| 2003/0033760 | A1 * | 2/2003 | Rogers | E02D 27/34 52/167.7 |
| 2014/0305048 | A1 * | 10/2014 | Ishii | E04H 9/021 52/167.1 |
| 2014/0360108 | A1 * | 12/2014 | Fujiu | F16F 15/04 52/167.7 |

* cited by examiner

SEISMIC ISOLATION DEVICE AND SEISMIC ISOLATION METHOD

CROSS-REFERENCE TO RELATED APPLICATION

This application is based upon and claims the benefit of priority from Japanese Patent Application No. 2014-217146, filed on Oct. 24, 2014, the entire contents of which are incorporated herein by reference.

BACKGROUND

Field

Embodiments of the present invention relate to a seismic isolation apparatus and a seismic isolation method.

Description of the Related Art

Seismic isolation devices have been introduced as earthquake countermeasures for structures, such as buildings, machines and equipment. The seismic isolation apparatus is generally composed of a soft member such as a laminated rubber, and an attenuation member such as an oil damper to prevent earthquake acceleration from being transmitted to a structure. The general seismic isolation apparatus composed of the soft member and the attenuation member is not always effective against a large long-period displacement response even if the general seismic isolation apparatus is effective against a short-period displacement response. The general seismic isolation apparatus has difficulty of designing seismic isolation for the large long-period displacement response.

That is, if a large long-period earthquake vibration beyond expectations is received, there is a possibility that a structure provided with a seismic isolation apparatus may break its member such as the laminated rubber due to exceeding a design allowable value.

Each of FIGS. 13 to 16 is a sectional view of a seismic isolation apparatus in accordance with examples of conventional seismic isolation apparatus.

For example, as illustrated in FIGS. 13 and 14, in order to cope with breakage in an elastic body 100 such as a laminated rubber, between a structure 101 and a foundation 102, there is an example (which will be referred to as "first example") of the seismic isolation apparatus that includes a bed slide 103 fixed to the elastic body 100 and the structure 101, an upper support body 104 that is brought into contact with the bed slide 103 if there is large displacement, a lower support body 106 composed of layer composition such as a rubber plate that elastically supports the upper support body 104, and the like, and in which characteristics of the elastic body 100 that is squeezed in a direction perpendicular to its lamination plane allows the structure 101 to land on the seismic isolation apparatus by using elastic and cushioning action between the upper support body 104 and the lower support body 106 before the elastic body 100 is broken to reduce impact force caused by dropping of the structure 101.

Further, as illustrated in FIG. 15, between the structure 101 and the foundation 102, there is an example (which will be referred to as "second example") of the seismic isolation apparatus that includes an upper sliding member 104 and a lower sliding member 106, provided with sliding faces so as to surround a periphery of a laminated rubber 100, and in which if the laminated rubber 100 is broken, the upper sliding member 104 and the lower sliding member 106 are brought into contact with each other to slide as well as support self-weight of the structure 101.

Furthermore, as illustrated in FIG. 16, in order to prevent the laminated rubber 100 provided between the structure 101 and the foundation 102 from breaking, there is an example (which will be referred to as "third example") of the seismic isolation apparatus that has a structure in which if an attachment face of the laminated rubber 100 receives a predetermined load, the laminated rubber 100 slides with respect to the foundation 102.

In the first example, since the lower support body 106 is composed of a rubber plate, and the like, energy generated by dropping of the structure 101 is converted into energy of elastic deformation, and then the energy, as it is, returns to the structure 101 as vibration energy. As a result, in the structure 101, there is a case where the energy generated by the dropping is not absorbed and consumed to cause vertical impulsive vibration. Further, if a number of elastic bodies 100 arranged are unevenly broken to cause a slight inclination to occur in the structure 101, there may be a case where dropping in accordance with an inclination angle is occurred, thereby causing impact force to be hardly absorbed.

The conventional method allowing the laminated rubber 100 to slide is not always effective against three-dimensional displacement in vertical and side-to-side directions even if the conventional method allowing the laminated rubber 100 to slide is effective against displacement in a side-to-side direction. As a result, it may be impossible to absorb impact force generated by the structure 101.

Further, the conventional method which is applied to the first to third examples has a possibility that the structure 101 may violently collide with the upper support body and the upper sliding member 104, the lower support body and the lower sliding member 106, or the like, to cause the members 104 and 106, and the structure 101, to be broken depending on vertical behavior of the structure 101 when the laminated rubber 100 is broken.

SUMMARY

The embodiments according to the present invention were made in consideration of the circumstances mentioned above and an object thereof is to provide a seismic isolation apparatus and a seismic isolation method, capable of absorbing drop impact force of a structure as well as eliminating a possibility that the structure or the like may be broken, if the structure receives a large long-period earthquake vibration beyond expectations.

In consideration of the circumstances described above, a seismic isolation apparatus in accordance with the embodiments according to the present invention is provided between a structure and a foundation floor, and the seismic isolation apparatus includes: a support plate that is provided so as to face the structure at a predetermined interval; a base plate that is fixed to the foundation floor; and an elasto-plastic damper that is provided between the support plate and the base plate to be fixed to the support plate and the base plate, wherein the elasto-plastic damper includes an inner cylinder inside which an elasto-plastic member is provided and an outer cylinder, and the inner cylinder and the outer cylinder are configured to mutually slide in axis direction thereof.

Further, a seismic isolation method in accordance with embodiments according to the present invention uses the seismic isolation apparatus described above, and the seismic isolation method absorbs earthquake vibration with respect to the structure by allowing the inner cylinder and the outer cylinder of the elasto-plastic damper to mutually slide in axis direction thereof, thereby causing a plastic deformation of the elasto-plastic member provided inside the inner cylinder.

DETAILED DESCRIPTION OF THE PREFERRED EMBODIMENTS

Hereunder, the present embodiments will be described with reference to the accompanying drawings. It is noted that terms "upper", "lower", "right", "left" and the likes indicating direction illustrated in the accompanying drawings or in a case of actual usage. The embodiments of the present invention provide a seismic isolation apparatus and a seismic isolation method, capable of absorbing drop impact force of a structure as well as eliminating a possibility that the structure or the like may be broken, if the structure receives a large long-period earthquake vibration beyond expectations.

(First Embodiment)

The seismic isolation apparatus and the seismic isolation method in accordance with a first embodiment, will be described.

Figure 1:
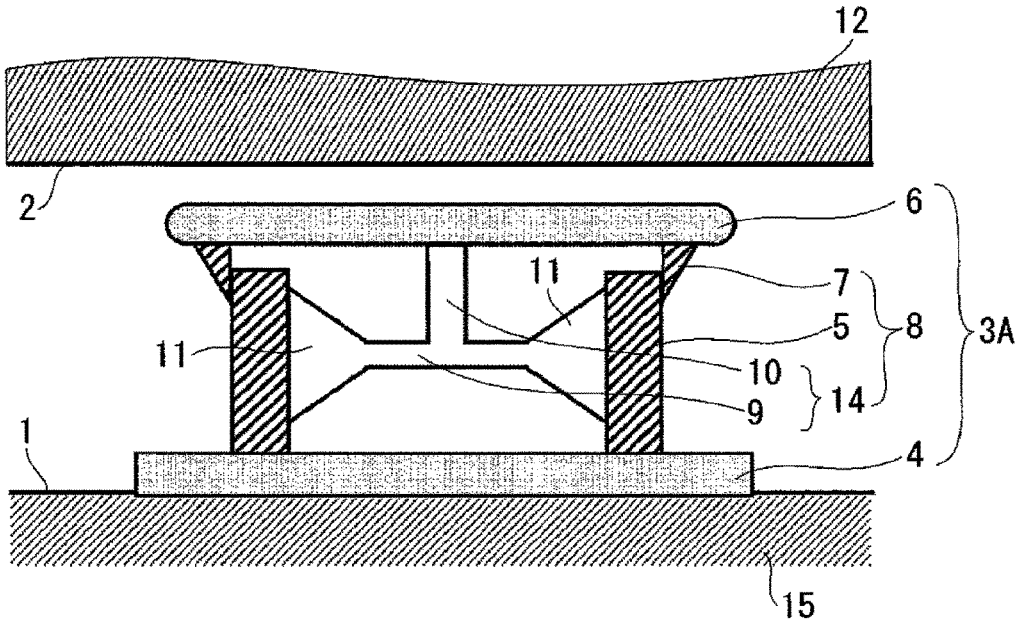
FIG. 1 is a sectional view illustrating first seismic isolation apparatus.

FIG. 1 is a sectional view illustrating a seismic isolation apparatus (which will be referred to as "first seismic isolation apparatus") 3A which is an example of a seismic isolation apparatus in accordance with first embodiment.

In accordance with FIG. 1, the first seismic isolation apparatus 3A includes a support plate 6, a base plate 4, and an elasto-plastic damper 8.

The support plate 6 is provided so as to face a lower surface 2 of a structure 12 at a predetermined interval. The base plate 4 is attached to a foundation floor 1 provided on a foundation 15. The support plate 6 is provided so as to secure a predetermined interval to the lower surface 2 of the structure 12, and so as not to be brought into contact with each other in a case where the first seismic isolation apparatus 3A is operated without being broken.

The elasto-plastic damper 8 includes an outer cylinder 7 attached to a lower surface of the support plate 6, and an inner cylinder 5 attached to an upper surface of the base plate 4. An elasto-plastic member 14 is provided inside the inner cylinder 5.

The outer cylinder 7 and the inner cylinder 5 are provided at a position in any one of the support plate 6 and the base plate 4, respectively, and height of both the cylinders 5 and 7 is set so as to at least partially overlap with each other. In the first seismic isolation apparatus 3A illustrated in FIG. 1, height of the inner cylinder 5 is set higher than height of the outer cylinder 7. Further, a sidewall of the outer cylinder 7 is set so as to be inverted triangle in cross section.

The elasto-plastic member 14 includes a vertical beam member 10 that is attached at a substantially central portion of the lower surface of the support plate 6, and a horizontal beam member 9 that is attached to the inner cylinder 5 through a pair of reinforcement plates 11 and a lower end of the vertical beam member 10. Here, the reinforcement plates 11 are provided to the inner cylinder 5 for the purpose of increasing in strength of the inner cylinder 5, and may thereby prevent from deformation of the inner cylinder 5. Incidentally, the horizontal beam member 9 may be directly attached to the inner cylinder 5. In short, the reinforcement plates 11 may be eliminated.

Any material is available for the elasto-plastic member 14 as far as achieving an elasto-plastic function, and metal, concrete, resin, or the like is preferable.

Figure 2:
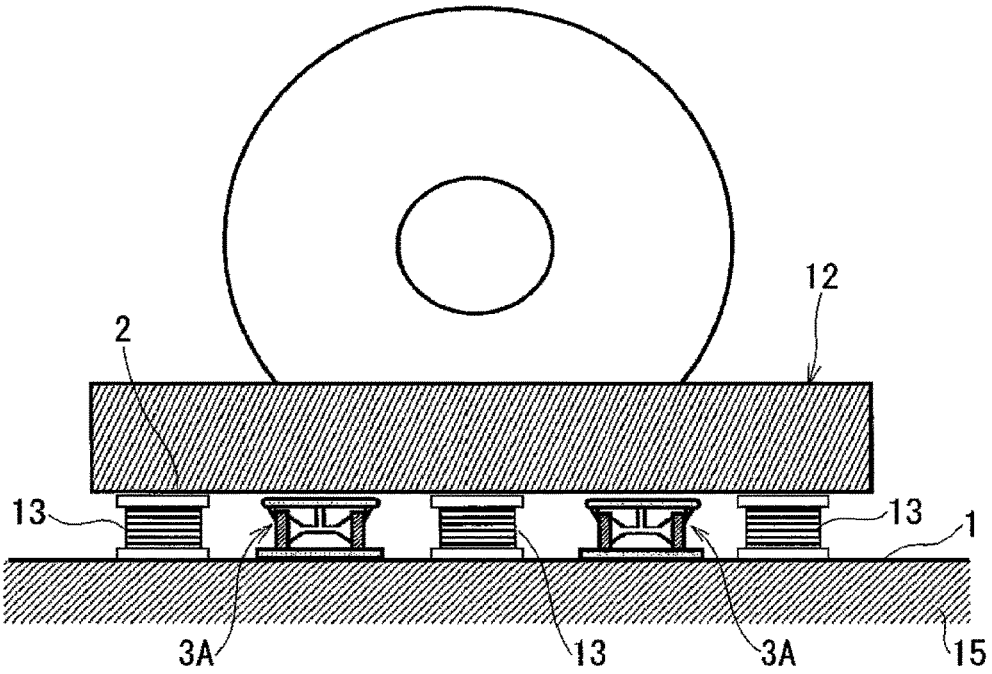
FIG. 2 is lateral view illustrating the first seismic isolation apparatus and illustrates an example in which the first seismic isolation apparatus is applied to a generator.

FIG. 2 illustrates an example in which the first seismic isolation apparatus 3A is applied to a generator as a structure 12, and in which a plurality of laminated rubbers 13 and a plurality of the first seismic isolation apparatuses 3A are alternately provided.

Subsequently, operation of the first seismic isolation apparatus 3A will be described.

Figure 3:
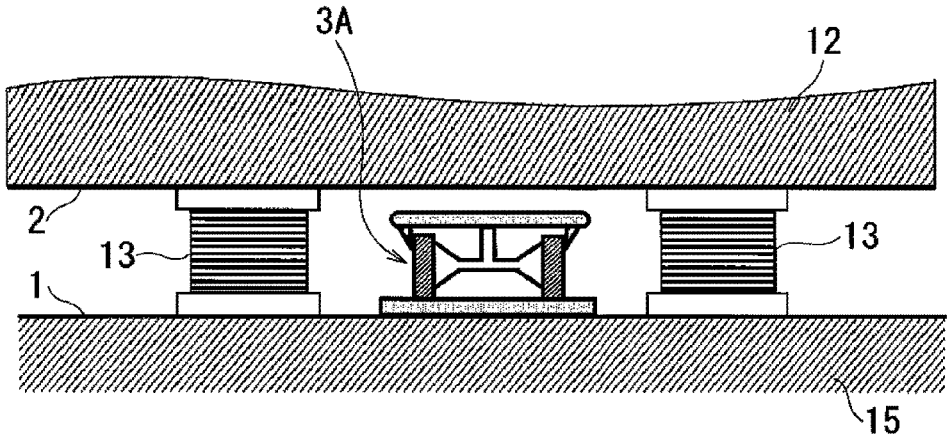
FIG. 3 is first lateral view illustrating operation of the first seismic isolation apparatus.
Figure 4:
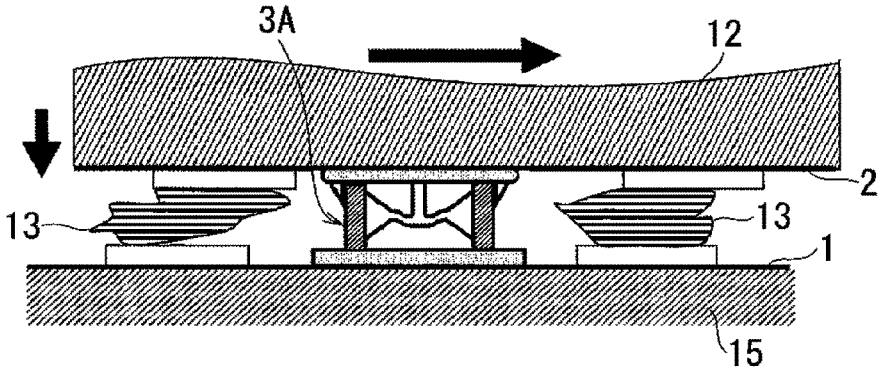
FIG. 4 is second lateral view illustrating operation of the first seismic isolation apparatus.
Figure 5:
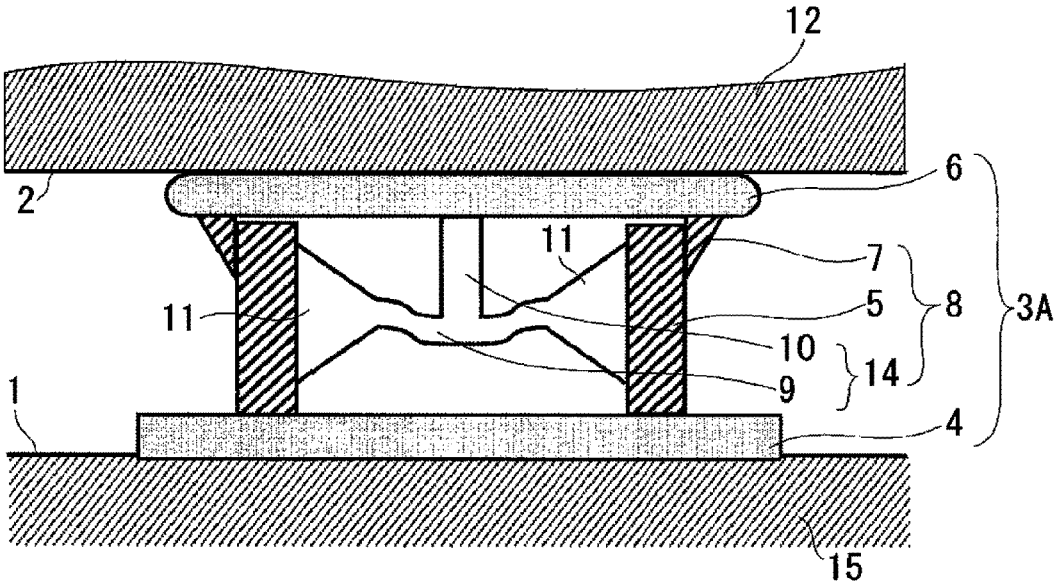
FIG. 5 is third lateral view illustrating operation of the first seismic isolation apparatus.

Each of FIGS. 3, 4, and 5 is a side view illustrating operation of the first seismic isolation apparatus 3A in a different state, concretely, FIG. 3 is first lateral view illustrating the first seismic isolation apparatus 3A in normal state, FIG. 4 is second lateral view illustrating the first seismic isolation apparatus 3A in a state where a large long-period earthquake vibration beyond expectations is received, and FIG. 5 is third lateral view illustrating the first seismic isolation apparatus 3A in a state where the support plate 6 is pressed downward.

During normal state (FIG. 3), the lower surface 2 of the structure 12 is vertically supported by the laminated rubber 13, and the lower surface 2 of the structure 12 and the first seismic isolation apparatus 3A are provided at a predetermined interval.

In a state where a large long-period earthquake vibration beyond expectations is received, as illustrated in FIG. 4, the lower surface 2 of the structure 12 is largely horizontally deformed (a right direction illustrated by an arrow in FIG. 4) to cause the laminated rubber 13 to be broken. As a result, since the laminated rubber 13 fails to support the lower surface 2 of the structure 12, the structure 12 falls downward (a downward direction illustrated by an arrow in FIG. 4). When the structure 12 falls on the first seismic isolation apparatus 3A, the first seismic isolation apparatus 3A supports the drop impact and self-weight of the structure 12.

That is, if the laminated rubber 13 is broken by a huge earthquake such as a large long-period earthquake vibration beyond expectations, the structure 12 drops, then contacts with the support plate 6, and thereby presses the support plate 6 downward. When the support plate 6 is pressed downward, the outer cylinder 7 is guided by the inner cylinder 5 to slide.

Further, the support plate 6 presses down the vertical beam member 10 to press down the central portion of the horizontal beam member 9. As a result, the horizontal beam member 9 is plastically deformed to be able to absorb and consume drop energy of the structure 12. In this way, if the structure 12 drops, it is possible to prevent vertical impulsive vibration from occurring.

According to the first embodiment, even if the structure 12 drops due to breakage of the laminated rubber 13, drop energy is absorbed and consumed by the plastic deformation of the elasto-plastic member 14 included in the elasto-plastic damper 8, formed of metallic material. As a result, the first seismic isolation apparatus 3A is possible to absorb the drop impact by reducing vibration and behavior that may cause the structure 12 to spring back.

When the support plate 6 is pressed downward, the first seismic isolation apparatus 3A is designed so that the support plate 6 seats on the upper surface of the inner cylinder 5 and the upper and lower surfaces of the inner cylinder 5 contacts with the support plate 6 and the base plate 4. For example, in the first seismic isolation apparatus 3A, since height of the inner cylinder 5 is set more than that of the outer cylinder 7, the self-weight of the structure 12 is supported to prevent excessive drop thereof. Conversely, there is a case where height of the outer cylinder 7 may be set more than that of the inner cylinder 5 so that a lower end of the outer cylinder 7 is brought into contact with the upper surface of the base plate 4. In this case, the first seismic isolation apparatus 3A is possible to support the self-weight of the structure 12 by restricting upward and downward displacement of the first seismic isolation apparatus 3A, allows the force supporting the self-weight to press the support plate 6 on the lower surface 2 of the structure 12. In a situation where the support plate 6 is pressed on the lower surface 2 of the structure 12, frictional force can be applied against horizontal displacement of the structure 12, thereby being possible to reduce the horizontal displacement of the structure 12.

The elasto-plastic member 14 may be designed so as to balance with energy of plastic deformation of the elasto-plastic damper 8 of the first seismic isolation apparatus 3A by calculating drop velocity and drop energy of the structure 12 in a final state, where the laminated rubber 13 is broken, from an interval between the first seismic isolation apparatus 3A and the lower surface 2 of the structure, an expected inclination of the structure 12, and the like.

The elasto-plastic member 14 included in the elasto-plastic damper 8 is not limited to that using plastic deformation of metal, and there may be a case where a structure in which concrete is used to absorb energy by crushing the concrete is available. In this case, since the elasto-plastic member 14 is enclosed by the inner cylinder 5 and the outer cylinder 7, the concrete crushed by absorbing drop impact stays inside the first seismic isolation apparatus 3A. Accordingly, the elasto-plastic damper 8 is not broken, and can therefore continue to support the self-weight of the structure 12.

In addition, the present embodiment is also applicable to vertical vibration so that drop impact of the structure 12, caused by breakage of the first seismic isolation apparatus 3A, can be absorbed.

(Second Embodiment)

The seismic isolation apparatus and the seismic isolation method in accordance with a second embodiment, will be described.

Figure 6:
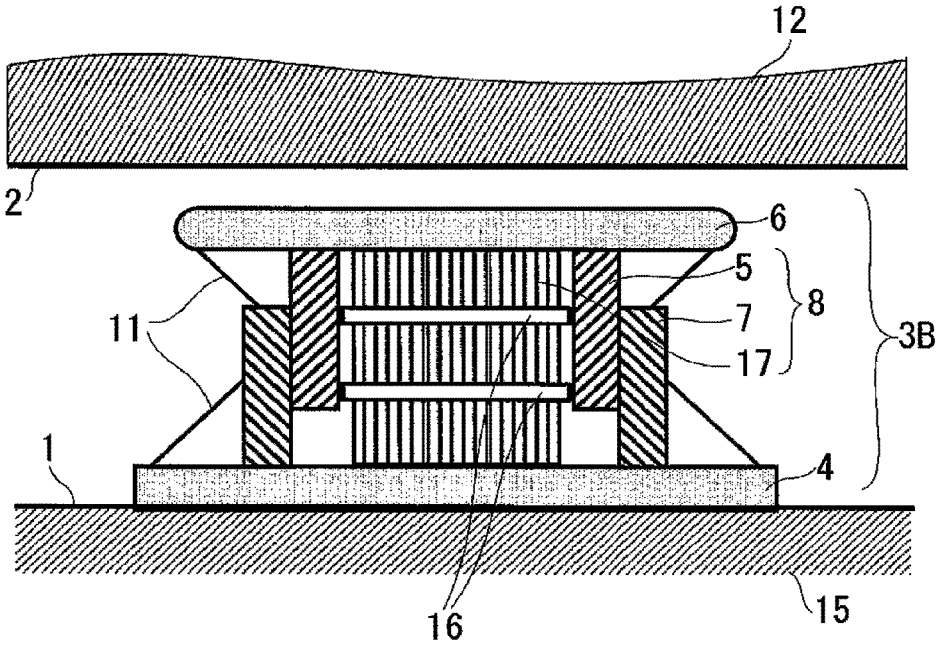
FIG. 6 is a sectional view illustrating second seismic isolation apparatus.

FIG. 6 is a sectional view of a seismic isolation apparatus (which will be referred to as "second seismic isolation apparatus") 3B which is an example of a seismic isolation apparatus in accordance with the second embodiment.

In accordance with FIG. 6, the second seismic isolation apparatus 3B has the same structure as that of the first seismic isolation apparatus 3A except that: the elasto-plastic member 14 is a rod-like body 17 formed of stainless steel or the like; the inner cylinder 5 and the outer cylinder 7 have the almost same height; a plurality of reinforcement plates 11 in the shape of triangle in cross section is provided along the inner cylinder 5 and the support plate 6, and along the outer cylinder 7 and the base plate 4; and the rod-like body 17 penetrates into the inner cylinder 5, and there is provided a connection plate 16 whose edge is fixed to the inner cylinder 5. The rod-like body 17 is a hollow or solid cylinder made of metal, a square tube, or a honeycomb structure, to be plastically deformed with respect to vertical displacement caused by vertical load. The reinforcement plate 11 is provided to increase joint strength between the inner cylinder 5 and the support plate 6, and joint strength between the outer cylinder 7 and the base plate 4, as well as to prevent deformation of the inner cylinder 5 and the outer cylinder 7, but may be eliminated.

Even in the present embodiment, as with the first embodiment, if the structure drops due to breakage of the laminated rubber 13 to cause the lower surface 2 thereof to collide with the support plate 6, the rod-like body 17 buckles to be plastically deformed. As a result, it is possible to support the structure at the lower surface 2. Then, since the rod-like body 17 is enclosed by the outer cylinder 7 and the inner cylinder 5, the rod-like body 17 stays inside the inner cylinder 5 even if absorbing drop impact to be deformed. As a result, it is possible to continue to support the self-weight of the structure 12. In addition, the force supporting the self-weight presses the support plate 6 on the lower surface 2 of the structure so that frictional force can be applied against horizontal displacement of the structure 12. As a result, it is possible to reduce the horizontal displacement of the structure 12.

The present embodiment achieves the same effect as that achieved by the first embodiment. In addition, since the present embodiment sets the inner cylinder 5 and the outer cylinder 7 at the almost same height, the inner cylinder 5 and the base plate 4, as well as the outer cylinder 7 and the support plate 6, are able to be simultaneously brought into contact with each other to be seated. As a result, it is possible to more reliably support the self-weight of the structure 12.

(Third Embodiment)

The seismic isolation apparatus and the seismic isolation method in accordance with a third embodiment, will be described.

Figure 7:
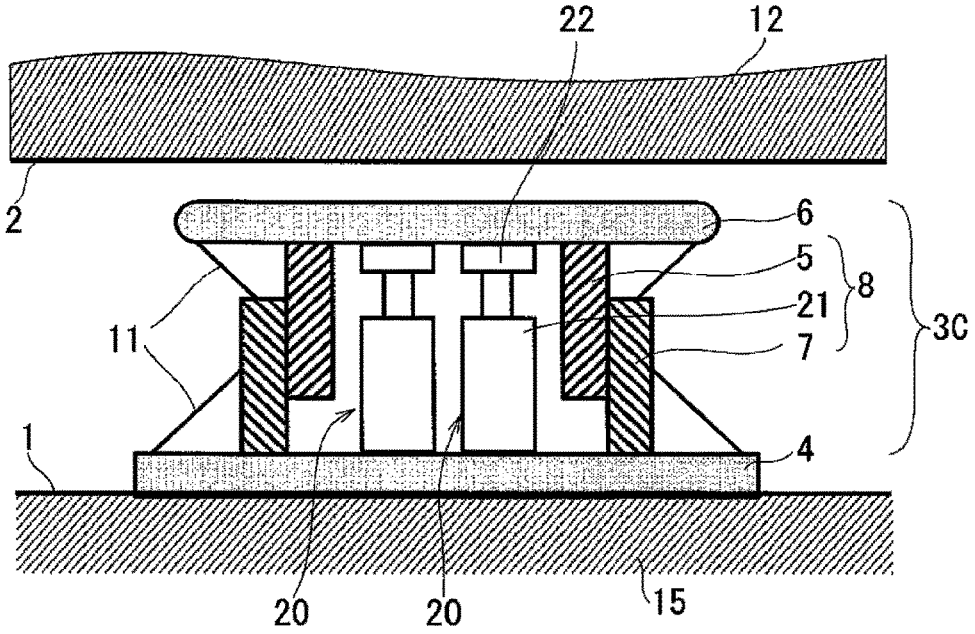
FIG. 7 is a sectional view illustrating third seismic isolation apparatus.

FIG. 7 is a sectional view of a seismic isolation apparatus (which will be referred to as "third seismic isolation apparatus") 3C which is an example of a seismic isolation apparatus in accordance with the third embodiment.

In accordance with FIG. 7, the embodiment has the same structure as that of the second seismic isolation apparatus 3B except that a plurality of viscous dampers 20 each of which is composed of a cylinder 21 and a piston rod 22 is provided instead of the rod-like body 17 and the connection plate 16, constituting the elasto-plastic member 14 in the second embodiment.

The viscous damper 20 is set so that internal pressure of the cylinder 21 allows the piston rod 22 to be pressed on the lower surface of the support plate 6 and operation of the third seismic isolation apparatus 3A within a rated range does not allow the support plate 6 and the lower surface 2 of the structure to be brought into contact with each other by securing a predetermined interval therebetween.

In the present embodiment, if the structure drops to cause the lower surface 2 thereof to collide with the support plate 6, the piston rod 22 is pushed into the cylinder 21 to absorb energy at collision by using a flow of viscous fluid in the cylinder 21. At this time, the piston rod 22 is pushed into an airtight space in the cylinder 21 to compress the viscous fluid in the cylinder 21, thereby changing volume of the viscous fluid. As a result, spring force pushing back the piston rod 22 to the outside of the cylinder 21 occurs to press the support plate 6 on the lower surface 2 of the structure.

According to the present embodiment, as with the embodiment 1, the elasto-plastic member 14 is capable of absorbing drop impact of the structure 12 caused by breakage of the laminated rubber 13. Since the viscous damper 20 is capable of generating vertical spring force, it is possible to continue to support the self-weight of the structure 12. Pressing the support plate 6 on the lower surface 2 of the structure enables frictional force to be applied against horizontal displacement of the structure 12, whereby it is possible to reduce the horizontal displacement of the structure 12.

(Fourth Embodiment)

The seismic isolation apparatus and the seismic isolation method in accordance with a fourth embodiment, will be described.

Figure 8:
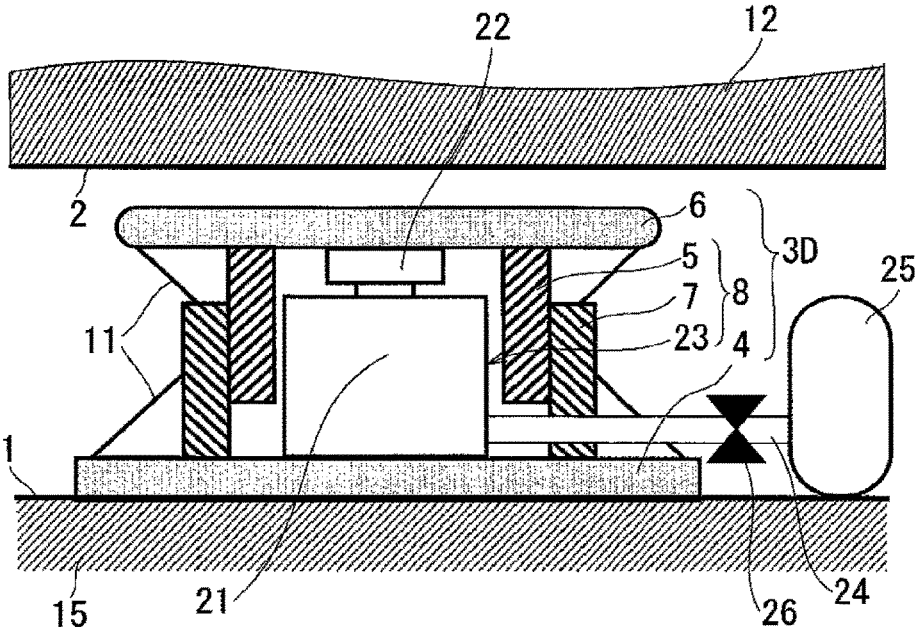
FIG. 8 is first sectional view illustrating fourth seismic isolation apparatus when an accumulator outflow valve is closed.
Figure 9:
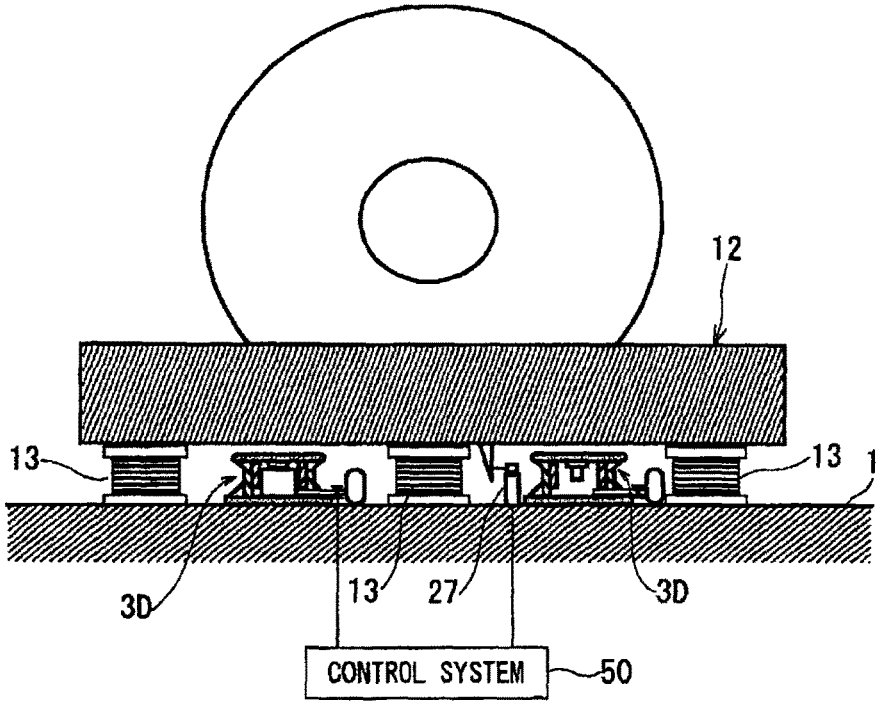
FIG. 9 is lateral view illustrating the fourth seismic isolation apparatus and illustrates an example in which the fourth seismic isolation apparatus is applied to a generator.

FIG. 8 is a sectional view (which will be referred to as "first sectional view") of a seismic isolation apparatus (which will be referred to as "fourth seismic isolation apparatus") 3D which is an example of a seismic isolation apparatus in accordance with fourth embodiment, when an accumulator outflow valve 26 is closed. FIG. 9 illustrates an example in which the fourth seismic isolation apparatus 3D is applied to a generator as the structure 12.

The fourth seismic isolation apparatus 3D has the same structure as that of the third seismic isolation apparatus 3C except that a hydraulic jack 23, an accumulator 25, and the like are provided instead of the viscous damper 20 included in the elasto-plastic member 14 of the third embodiment.

In the present embodiment, the fourth seismic isolation apparatus 3D, for example, includes the hydraulic jack 23 provided with the cylinder 21 and the piston rod 22, piping 24 through which hydraulic oil is fed to the cylinder 21, an accumulator 25 that accumulates hydraulic pressure, the accumulator outflow valve 26 through which the hydraulic oil is fed, and a displacement gauge 27 that measures horizontal displacement of the structure 12 to be used as an input signal to a control system that controls opening/closing of the accumulator outflow valve 26. The displacement gauge 27 is configured to be able to measure displacement of the structure 12 on the foundation floor 1. If the structure 12 is relatively light in weight, the hydraulic jack 23 may be composed of an air jack or an air bag.

Figure 10:
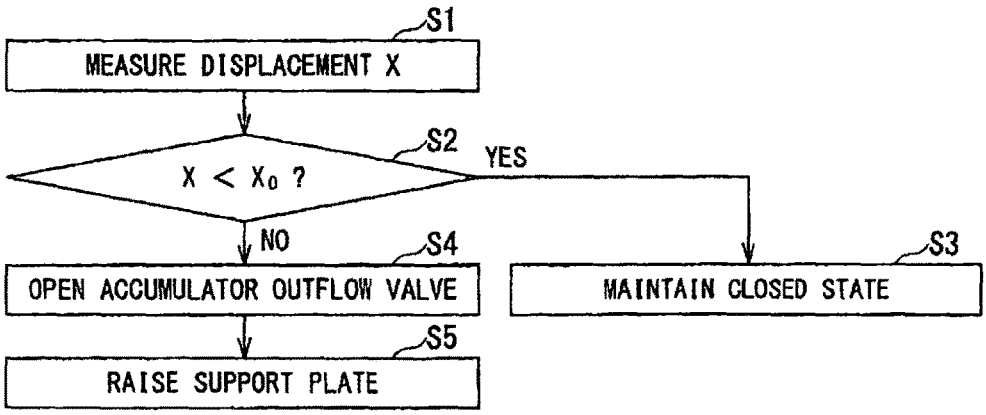
FIG. 10 is a flow chart of operation of the fourth seismic isolation apparatus.

FIG. 10 is a flow chart of operation of the fourth seismic isolation apparatus 3D.

In the present embodiment, if an earthquake occurs, the control system measures displacement X of the structure 12 on the basis of a measurement signal from the displacement gauge 27 to determine whether the displacement X exceeds predetermined displacement $X_o$, such as allowable displacement beyond which the laminated rubber 13 starts breaking (Step S1). If the displacement X is less than the allowable displacement $X_o$ ($X<X_o$) (In case of "YES" at Step S2), the accumulator outflow valve 26 is not opened to maintain a closed state (Step S3). On the other hand, if the displacement X is the allowable displacement $X_o$ or more ($X \geq X_o$) (In case of "NO" at Step S2), the accumulator outflow valve 26 is opened (Step S4). Then, hydraulic oil whose pressure is accumulated in the accumulator 25 is fed into the cylinder 21 through the accumulator outflow valve 26 opened to push up the piston rod 22 to raise the support plate 6 (Step S5). As a result of performing the step S5, the support plate 6 raised is pressed on the lower surface 2 of the structure 12, and then pushes (supports) the structure 12.

Figure 11:
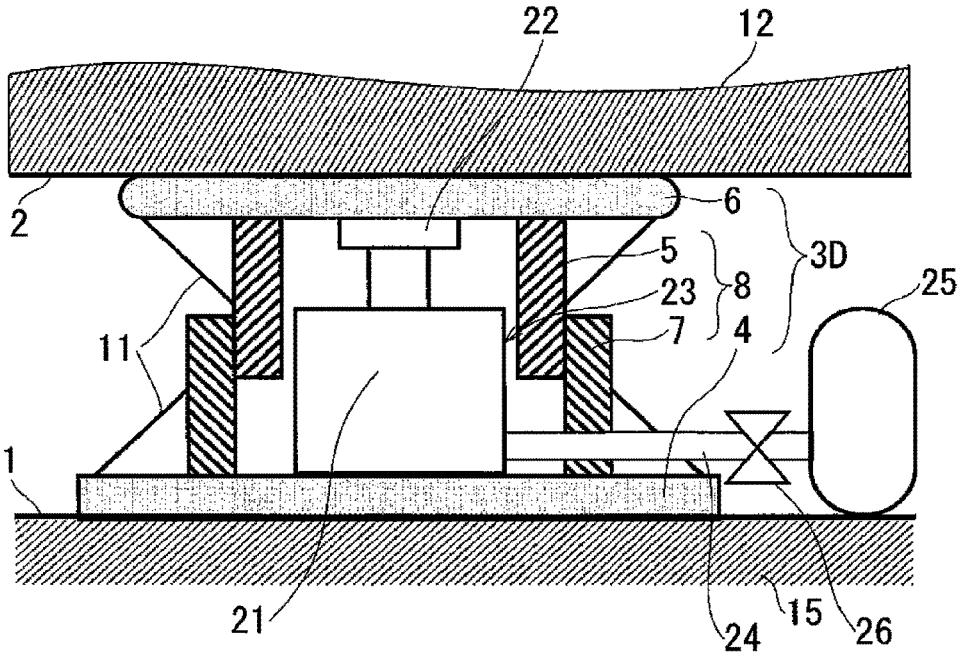
FIG. 11 is second lateral view illustrating operation of the fourth seismic isolation apparatus after the accumulator outflow valve is open, thereby supporting the structure by the support plate.

FIG. 11 is a sectional view (which will be referred to as "second sectional view") of the fourth seismic isolation apparatus 3D after the accumulator outflow valve 26 is open, thereby supporting the structure 12 by the support plate 6.

That is, the fourth seismic isolation apparatus 3D illustrated in FIG. 11 is a state where the step S5 in the flow chart illustrated in FIG. 10 is completed. As illustrated in FIG. 11, if the displacement measured by the displacement gauge 27 is the allowable displacement, since the accumulator outflow valve 26 is opened to raise the support plate 6, the fourth seismic isolation apparatus 3D can support the structure 12 by the support plate 6.

According to the present embodiment, the elasto-plastic member 14 is capable of absorbing drop impact of the structure 12 caused by breakage of the laminated rubber 13 by using cushion effect by hydraulic oil of the cylinder 21, as well as is capable of continuing to support the self-weight of the structure 12 by using hydraulic pressure. In addition, pressing the support plate 6 on the lower surface 2 of the structure enables frictional force to be applied against horizontal displacement of the structure 12, whereby it is possible to reduce the horizontal displacement of the structure 12.

In the fourth seismic isolation apparatus 3D described above, although the displacement gauge 27 is configured as a displacement measurement unit that measures displacement of the structure 12, the displacement gauge 27 may be configured as a drop detector that detects whether displacement of the structure 12 is less than a threshold value given as a value for determining drop of the structure 12 or not so that the hydraulic jack 23 is operated for a measurement signal to the control system. Further, the drop detector may be configured by a sensing unit for detecting drop of the structure 12. In other words, there may not be only a case where the unit 27 (FIG. 9) is the displacement gauge as the drop detector but be also a case where the unit 27 (FIG. 9) is the drop detector other than the displacement gauge.

As another example of the fourth seismic isolation apparatus 3D, the fourth seismic isolation apparatus 3D may adopt another configuration of contact surface between the structure 12 and the support plate 6.

Figure 12:
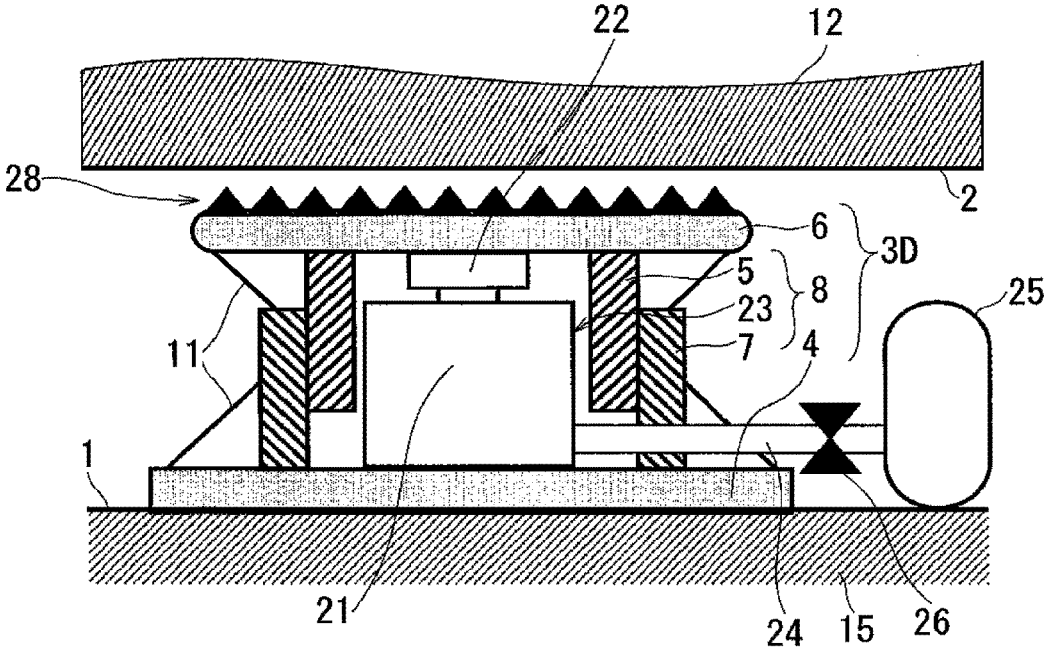
FIG. 12 is a lateral view illustrating another example of the fourth seismic isolation apparatus.
Figure 13:
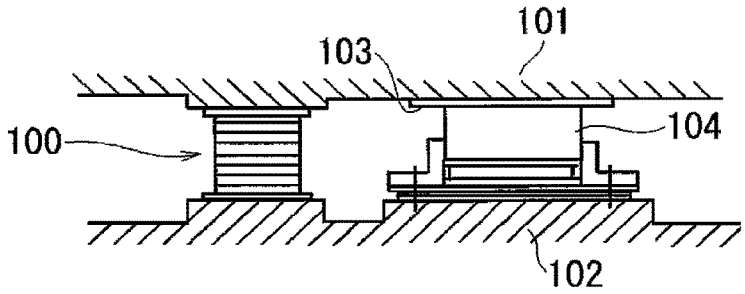
FIG. 13 PRIOR ART
FIG. 13 is a sectional view of first example of conventional seismic isolation apparatus.
Figure 14:
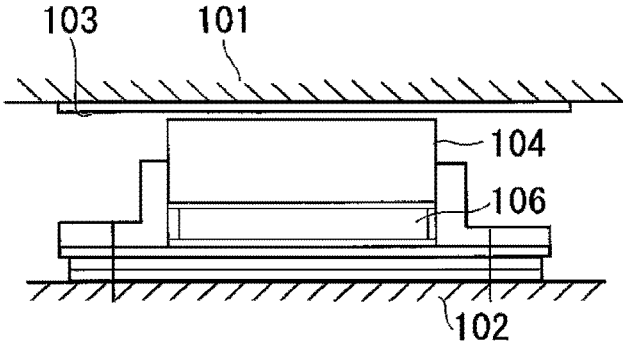
FIG. 14 PRIOR ART
FIG. 14 is enlarged sectional view of a part of the first example illustrated in FIG. 13.
Figure 15:
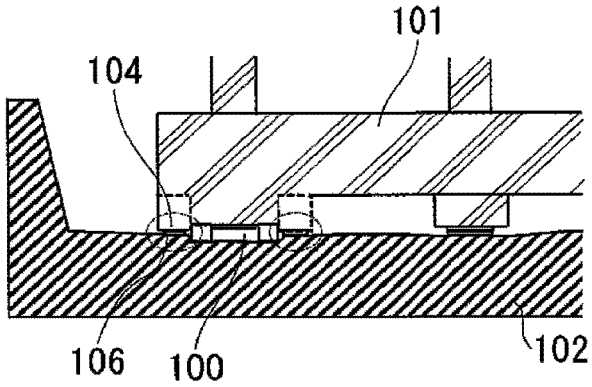
FIG. 15 PRIOR ART
FIG. 15 is a sectional view of second example of conventional seismic isolation apparatus.
Figure 16:
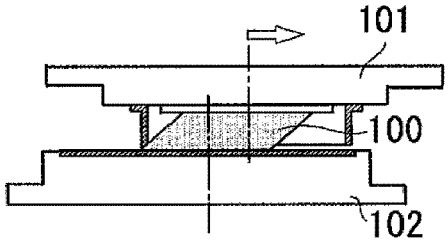
FIG. 16 PRIOR ART
FIG. 16 is a sectional view of third example of conventional seismic isolation apparatus.

FIG. 12 is a lateral view illustrating the fourth seismic isolation apparatus 3D as another example, adopting another configuration of contact surface between the structure 12 and the support plate 6.

In the fourth seismic isolation apparatus 3D illustrated in FIG. 12, protrusion unit 28 as a scabrous portion is further attached to the support plate 6. The protrusion unit 28 has an upper surface on which protrusions are arranged and a lower surface contacting with the upper surface on the support plate 6. Since the scabrous portion enables large frictional force to be applied against horizontal displacement of the structure 12, the fourth seismic isolation apparatus 3D further arranging the scabrous portion on the support plate 6 can further reduce the horizontal displacement of the structure 12 and thereby restrict displacement for seismic isolation.

In FIG. 12, although the protrusion unit 28 is configured as different component from the support plate 6, the protrusion unit 28 as the scabrous portion may be integrally configured as upper surface of the support plate 6. That is, the support plate 6 may be provided with protrusions as a scabrous portion are arranged on the upper surface of the support plate 6, or the support plate 6 may be formed so that protrusions as a scabrous portion are arranged on the upper surface of the support plate 6.a18

Incidentally, the configuration providing the scabrous portion to the support plate 6 is an example which enables large frictional force to be applied against horizontal displacement of the structure 12, and may not only adopted in the fourth seismic isolation apparatus 3D but may also adept be adopted in the other seismic isolation apparatuses such as the first to third seismic isolation apparatuses 3A to 3C.

The seismic isolation apparatus and the seismic isolation method in accordance with the embodiments described above are capable of absorbing drop impact force of a structure if the structure receives a large long-period earthquake vibration beyond expectations.

Since the embodiments described above are presented as examples, there is no intention to limit the scope of the invention. These novel embodiments can be practiced in other various aspects, and thus various omissions, replacements, modifications, and combinations may be made within a range without departing from the essence of the invention in consideration of common general technical knowledge of a person skilled in the art. These embodiments and their variations are included in the scope and essence of the invention as well as in a range equal to that of the invention described in the Claims.

What is claimed is:

1. A seismic isolation apparatus that is provided between a structure supported by laminated rubber and a foundation floor, the seismic isolation apparatus comprising:

a support plate that is provided so as to face the structure at a predetermined interval and is separated from the structure;

a base plate that is fixed to the foundation floor; and an elasto-plastic damper that is provided between the support plate and the base plate to be fixed to the support plate and the base plate, wherein the elasto-plastic damper includes an inner cylinder inside which an elasto-plastic member to support the support plate is provided and an outer cylinder, and the inner cylinder and the outer cylinder are configured to mutually slide in axis direction thereof.

2. The seismic isolation apparatus according to claim 1, wherein the elasto-plastic member includes a first beam member of which both ends are respectively attached to an inner literal lateral surface of the inner cylinder, and a second beam member of which one end is attached to a lower surface of the support plate and another end is connected to the first beam member.

3. The seismic isolation apparatus according to claim 1, wherein the elasto-plastic member is formed of any one of metal, concrete, and resin.

4. The seismic isolation apparatus according to claim 1, wherein the elasto-plastic member is formed of a rod-like body made of metal and is attached between a lower surface of the support plate and an upper surface of the base plate.

5. The seismic isolation apparatus according to claim 1, wherein the elasto-plastic member is configured by a viscous damper and is attached between a lower surface of the support plate and an upper surface of the base plate.

6. The seismic isolation apparatus according to claim 1, wherein the elasto-plastic member is configured by a hydraulic jack provided with a piston rod and is attached between a lower surface of the support plate and an upper surface of the base plate.

7. The seismic isolation apparatus according to claim 6, further comprising:

a displacement measurement unit that is provided on the foundation floor to measure displacement of the structure; and a control system that determines whether a displacement measured by the displacement measurement unit exceeds a predetermined displacement or not, and controls the hydraulic jack to push up the piston rod to raise the support plate if the control system determines that the displacement measured by the displacement measurement unit exceeds the predetermined displacement.

8. The seismic isolation apparatus according to claim 6, further comprising:

a drop detector that is provided on the foundation floor to detect drop of the structure; and a control system that determines whether the drop detector detects drop of the structure or not, and controls the hydraulic jack to push up the piston rod to raise the support plate if the control system determines that drop of the structure is detected.

9. The seismic isolation apparatus according to claim 1, wherein the support plate is provided with a scabrous portion on an upper surface thereof.

10. The seismic isolation apparatus according to claim 1, further comprising a protrusion unit attached to an upper surface of the support plate, the protrusion unit having an upper surface on which protrusions are arranged and a lower surface contacting with the upper surface on the support plate.

11. A seismic isolation method that uses the seismic isolation apparatus according to claim 1, the seismic isolation method comprising:

supporting the structure by the support plate when the laminated rubber is broken by an earthquake vibration; and absorbing the earthquake vibration with respect to the structure by allowing the inner cylinder and the outer cylinder of the elasto-plastic damper to mutually slide in an axis direction thereof, thereby causing a plastic deformation of the elasto-plastic member provided inside the inner cylinder.

12. The seismic isolation apparatus according to claim 1, wherein the support plate is physically and mechanically separated from the structure.

* * * * *